US005666597A

United States Patent [19]

Sasame et al.

[11] Patent Number: 5,666,597

[45] Date of Patent: Sep. 9, 1997

[54] IMAGE FORMING APPARATUS WITH DELAYED DISCHARGE BY DISCHARGE MEANS

[75] Inventors: Hiroshi Sasame; Haruo Fujii, both of Yokohama; Tatsuhiko Hayakawa, Tokyo; Tatsuya Kobayashi, Sohka; Tetsuya Kobayashi, Kawasaki; Naoki Enomoto, Yokohama; Akihiko Uchiyama, Yokohama; Yoshiro Saito, Yokohama; Youichirou Maebashi, Yokohama, all of Japan

[73] Assignee: Canon Kabushiki Kaisha, Tokyo, Japan

[21] Appl. No.: 727,316

[22] Filed: Oct. 8, 1996

Related U.S. Application Data

[63] Continuation of Ser. No. 322,568, Oct. 13, 1994, abandoned.

[30] Foreign Application Priority Data

Oct. 14, 1993 [JP] Japan ..... 5-280478
Oct. 14, 1993 [JP] Japan ..... 5/280480

[51] Int. Cl.[6] ..... G03G 21/00; G03G 21/06; G03G 21/08

[52] U.S. Cl. ..... 399/128; 399/167; 399/169; 399/303; 399/320

[58] Field of Search ..... 399/38, 50, 66, 399/67, 303, 169, 167, 297, 320, 127, 128

[56] References Cited

U.S. PATENT DOCUMENTS 4,772,916 9/1988 Mochida .
4,785,324 11/1988 Yamazaki et al. ..... 399/128
5,249,023 9/1993 Miyashiro et al. .
5,260,751 11/1993 Inomata .
5,287,163 2/1994 Miyashiro et al. .
5,521,680 5/1996 Young ..... 355/219
5,523,829 6/1996 Miyashiro et al. ..... 399/167 X

FOREIGN PATENT DOCUMENTS 577490 1/1994 European Pat. Off. .
2607727 9/1976 Germany .
50-50935 5/1975 Japan .
50-93437 7/1975 Japan .
4-303858 10/1992 Japan .
2148190 5/1985 United Kingdom .

*Primary Examiner*—S. Lee
*Attorney, Agent, or Firm*—Fitzpatrick, Cella, Harper & Scinto

[57] ABSTRACT

An image forming apparatus includes an image bearing member for bearing an image, the image bearing member being rotatable at a first speed and a second speed which is different from the first speed, wherein during image formation on the image bearing member, the first speed is selected, and after completion of image formation on the image bearing member, a speed of rotation of the image bearing member is switchable from the first speed to the second speed; a discharger for electrically discharging the image bearing member at a discharging position, the discharger discharging the image bearing member at least one turn after the trailing edge of the image on the image bearing member passes through the discharging position and before the speed of the image bearing member is switched from the first speed to the second speed.

42 Claims, 6 Drawing Sheets

IMAGE FORMING APPARATUS WITH DELAYED DISCHARGE BY DISCHARGE MEANS

This application is a continuation of application Ser. No. 08/322,568, filed Oct. 13, 1994, now abandoned.

FIELD OF THE INVENTION AND RELATED ART

The present invention relates to an image forming apparatus, more particularly to such an apparatus in which a speed of an image bearing member or a recording material carrying member is changeable, further particularly to a color image forming apparatus in which images are superposedly transferred onto a recording material from an image bearing member.

A multi-color image forming apparatus is known as disclosed in German Patent Publication No. 2607727 or Japanese Laid-Open Patent Application No. 50-50935. When a color image is formed on a transparent resin sheet for an overhead projector (OHP sheet) in the conventional multi-color image forming apparatus, the light transmission is required for the print. This is because, in the case of the overhead projector, the light transmitted through the print is projected, and therefore, if the transparency is poor, the projected image is dark (blackish) even to the worst extent that the image is projected as black and white image.

In order to assure the transparency, it is desired that in the fixing step after the transfer of the toner onto the recording material from the image bearing member, a sufficient amount of sheet is applied to the developer to smooth the surface of the developer after the image fixing. However, it is difficult to rise the fixing temperature because of the sheet durability and service life of the image fixing apparatus. Therefore, in the apparatus used recently, the distance from a position where the transfer material is separated from a transfer drum for carrying the recording material or transfer material to the fixing position is made longer than the length of the transfer material, and when the sheet for the overhead projector (OHP) sheet is used, the transfer material feeding speed is reduced in the path after the separation of the transfer material from the transfer drum to the fixing station, without changing the image formation speed excepts for the fixing station, and the sufficient heat is applied during the fixing operation.

According to this method, the sufficient heat can be applied during the fixing operation without changing the process speed except for the sheet feeding and the fixing operation after the sheet separation, that is, without influence to the latent image formation and the developing process involving the photosensitive member. Therefore, an OHP print having good transparency can be provided without influence to the image bearing member (photosensitive member) or the developing operation therefor. In this example, the normal process speed is 100 mm/sec, and it is 40 mm/sec for the OHP sheet.

To accomplish this, the conventional method is such that the distance Ld from the separating position to the fixing position is made longer than the length of the transfer material, by which the fixing operation starts after the image transfer operation is completed. This however, results in bulkiness of the apparatus.

The recent demand for the downsizing of the office equipment extends to multi-color image forming machines, and therefore, the efforts have been made to reduce the distance from the transfer position to the fixing position. In order to produce satisfactory OHP sheet print with reduced distance between the transfer position to the fixing position, the speed at the fixing position should be reduced. In this case, the leading edge of the transfer material enters the fixing position before the completion of the separation of the transfer material from the photosensitive drum. To avoid the problem, Japanese Laid-Open Patent Application No. 4.303858 or EPA 577490 disclose that after the termination of the transfer step, the transfer drum is rotated additionally through one full-turn while maintaining the transfer material on the transfer drum, and before the transfer material is separated, the speed is reduced; and thereafter, the separation and fixing operations are carried out. By doing so, the size of the apparatus can be reduced, and a high quality prints can be provided on the OHP sheet.

However, when the image forming operation is executed through this method, and when the speed is simply reduced, the charging condition and the exposing condition are not proper for the image bearing member with the result of charging memory, exposure memory or the like, and therefore, the image is remarkably damaged.

In order to avoid the inconveniences, it would be possible to provide, downstream of the primary charger for the photosensitive drum, for example, a discharging device which operates only when the process speed is reduced. However, this would result in increase of the size of the photosensitive drum, against the demand for the downsizing.

In addition, upon the completion of the image formation, the photosensitive drum is also discharged. In this case, the discharging condition changes by the reduction of the process speed, and therefore, the discharging is Not satisfactory. Then, no good image can be produced upon the next image forming operation.

SUMMARY OF THE INVENTION

It is a principal object of the present invention to provide an image forming apparatus in which memory in an image bearing member is prevented irrespective of the moving speed change of the image bearing member.

It is another object of the present invention to provide an image forming apparatus in which an image bearing member and/or a recording material carrying member are properly discharged irrespective of the change of the moving speed of the image bearing member and/or the recording material carrying member.

It is a further object of the present invention to provide an image forming apparatus having a small size.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Referring to the accompanying drawings, the embodiments of the present invention will be described in detail.

Figure 1:
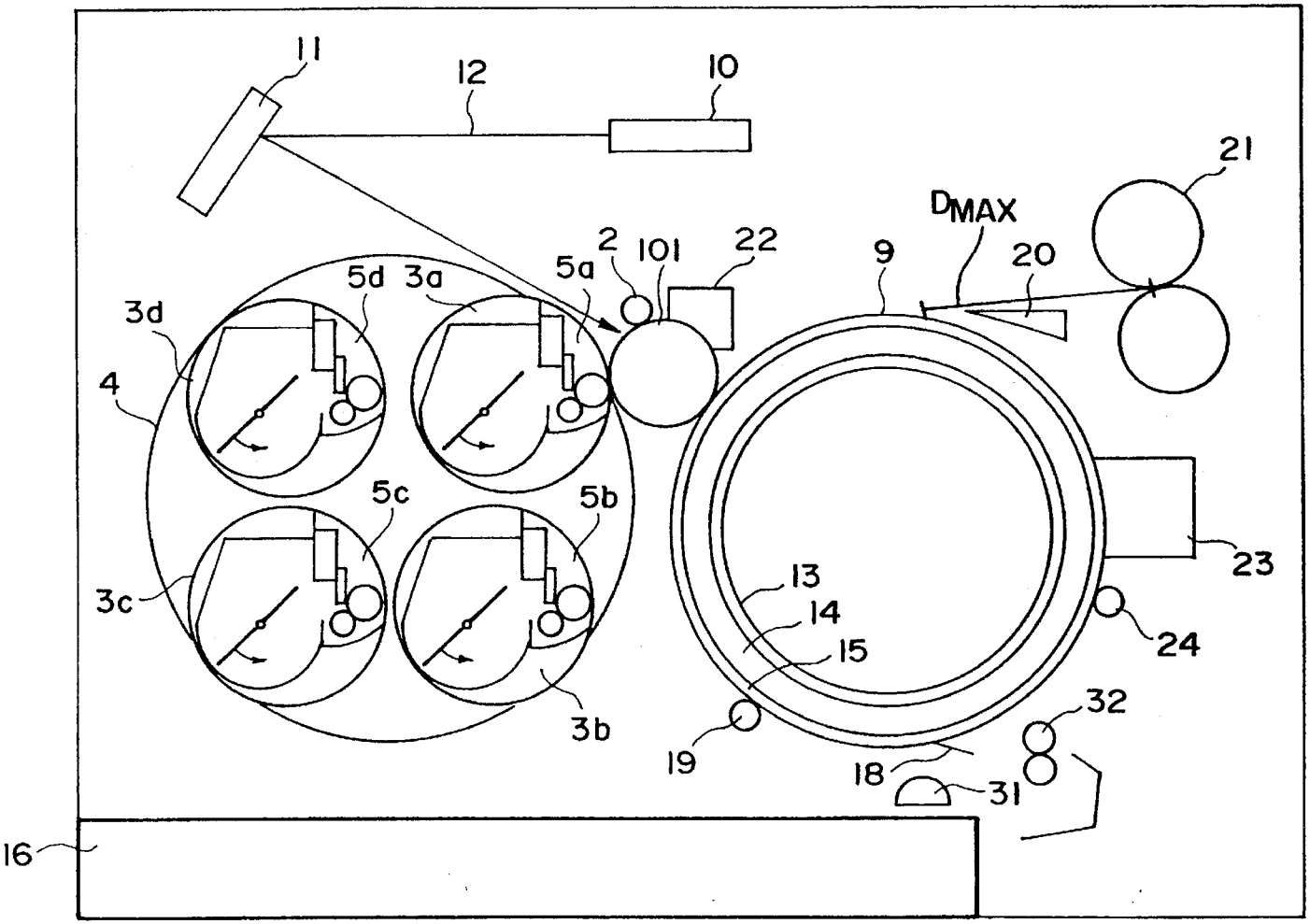
FIG. 1 is a general arrangement of a multi-color image forming apparatus according to a first and sixth embodiment.

Referring to FIG. 1, there is shown a color laser beam printer, in cross-section, as an exemplary image forming apparatus.

As shown in this Figure, the apparatus comprises a photosensitive drum 101 as an image bearing member, a roller charger 2. At the left side of the photosensitive drum, there is a developing apparatus including a plurality of developing devices 3*a*, 3*b*, 3*c* and 3*d* which are supported on a rotatable support 4 in the manner that developing openings 5*a*, 5*b*, 5*c* and 5*d* of the developing devices 3*a*, 3*b*, 3*c* and 3*d* are disposed on the same circumference with the center thereof being the rotational axis of the support.

Figure 4:
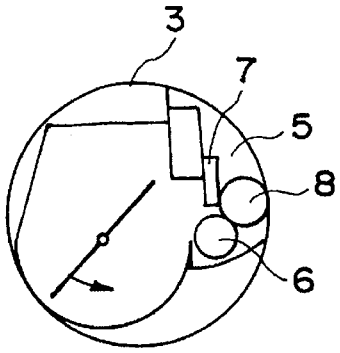
FIG. 4 is an enlarged sectional view of a developing apparatus.

The developing devices 3*a*, 3*b*, 3*c* and 3*d* contain yellow toner, magenta toner, cyan toner and black toner. As shown in FIG. 4, there are provided application rollers 6 and toner regulating members 7. With rotation of the developing roller 8, the toner is applied on the developing roller 8 by the application roller 6, and required triboelectric charge is applied to the toner by toner regulating member 7. The material Of the toner regulating member is preferably nylon or the like when the toner is to be charged to the negative polarity. On the contrary, it is to be charged to the positive polarity, the silicone rubber or the like are preferred. In any case, the material charged to the polarity opposite from that of the toner is preferable. Additionally, the peripheral speed of the developing roller 8 is preferably 1.0–2.0 times the peripheral speed of the photosensitive drum 101. The developing devices 3*a*, 3*b*, 3*c* and 3*d* on the support 4, as shown in FIG. 1, is such that the developing openings 5*a*, 5*b*, 5*c* and 5*d* of the developing devices 3*a*, 3*b*, 3*c* and 3*d* are faced always to the photosensitive drum 101. The driving means may be the one disclosed in Japanese Laid-Open Patent Application No. 50-93437.

At the right side of the photosensitive drum 101, there is a transfer drum 9 (recording material carrying member) for carrying the recording material or the transfer material and for transferring the image from the photosensitive drum 101 onto the transfer material.

The photosensitive drum 101 is rotated in the direction indicated by an arrow at the peripheral speed of 100 mm/sec by driving means. The photosensitive drum 101 comprises an aluminum cylinder having a diameter of 80 mm and an organic photoconductor (OPC) thereon. The organic photoconductor may be replaced with A-Si, CdS, Se or the like.

At the upper position of the main assembly of the apparatus, there is an exposure device comprising a laser diode, a polygonal mirror rotated by high speed motor, an optical unit 10 including lens and folding mirror 11.

The charging roller 2 is supplied with a DC based AC voltage including a DC component of −700 V and an AC component having a frequency of 1000 Hz and a peak-to-peak voltage Vpp of 1500 V, so that the surface of the photosensitive drum is uniformly charged to approx. −700 V.

When the laser diode receives the signal indicative of the yellow image pattern, the laser beam is incident on the photosensitive drum 101 through the optical path 12, so that the potential of the portion exposed to the laser beam becomes approx. −100 V. When the photosensitive drum 101 further rotates in the direction indicated by an arrow, the latent image is visualized by the developing devices 3*a*, 3*b*, 3*c* and 3*d*.

The description will be made as to the image transfer step. The transfer drum 9 comprises a metal cylinder 13 having a diameter of 156 mm, an elastic layer 14 of foamed urethane having a thickness of 2 mm wrapped therearound, and an upper layer of 100 μm in thickness and of dielectric sheet (polyvinylidene fluoride (PVDF)) 15, wrapped therearound.

A transfer material is fed out by a pick-up roller not shown, from a transfer material cassette 16. It is retained on the transfer drum by a gripper 18, and is electrostatically attracted on the transfer drum by the attraction roller 19 supplied with the voltage.

The toner image is transferred from the photosensitive drum 101 onto the transfer material attracted on the transfer drum 9 by the voltage applied on the transfer drum 9 by the voltage source not shown in the drawing.

The above-described steps are repeated for the magenta, cyan and black colors, by which a multi-color toner image is superimposedly formed on the transfer material. The transfer material is separated from the transfer drum 9 by separation claws, and the toner image is fused and fixed on the transfer material by known fixing device 21 which heats and presses the toner image. The distance $D_{max}$ from the separation position of the transfer drum 9 to the fixing device is smaller than the maximum length of the transfer material measured in the direction of the transfer material feeding.

The residual toner remaining on the photosensitive drum 101 is removed from the photosensitive drum 101 by known fur brush, blade means or another cleaning device 22. Additionally, the photosensitive drum 101 is electrically discharged and initialized. In the case of FIG. 1, the discharging means for the photosensitive drum 101 is in the form of a charging roller 2. In order to discharge the photosensitive drum 101, the DC component of the alternating voltage applied is substantially 0 V, while the AC component remains unchanged.

It is preferable that the toner on the transfer drum 9 is removed by a transfer drum cleaning device 23 such as a fur brush, web or the like.

The transfer drum 9 is electrically discharged and initialized by a discharging roller 24.

The fixing step will be described. In a multi-color image forming apparatus, yellow, magenta, cyan toners are fused and mixed to produce natural color, or basic seven colors including red, green and blue. Therefore, the toner is given a sharp-melt property for the better mixing. Additionally, in order to supply sufficient heat, a relatively large nip is formed, and sufficient pressure is imparted to promote the color mixing. More particularly, in the case of monochromatic image formation 5–10 kg pressure is applied, whereas in the color image forming apparatus in this embodiment, a high pressure such as 30–50 kg is imparted.

Figure 2:
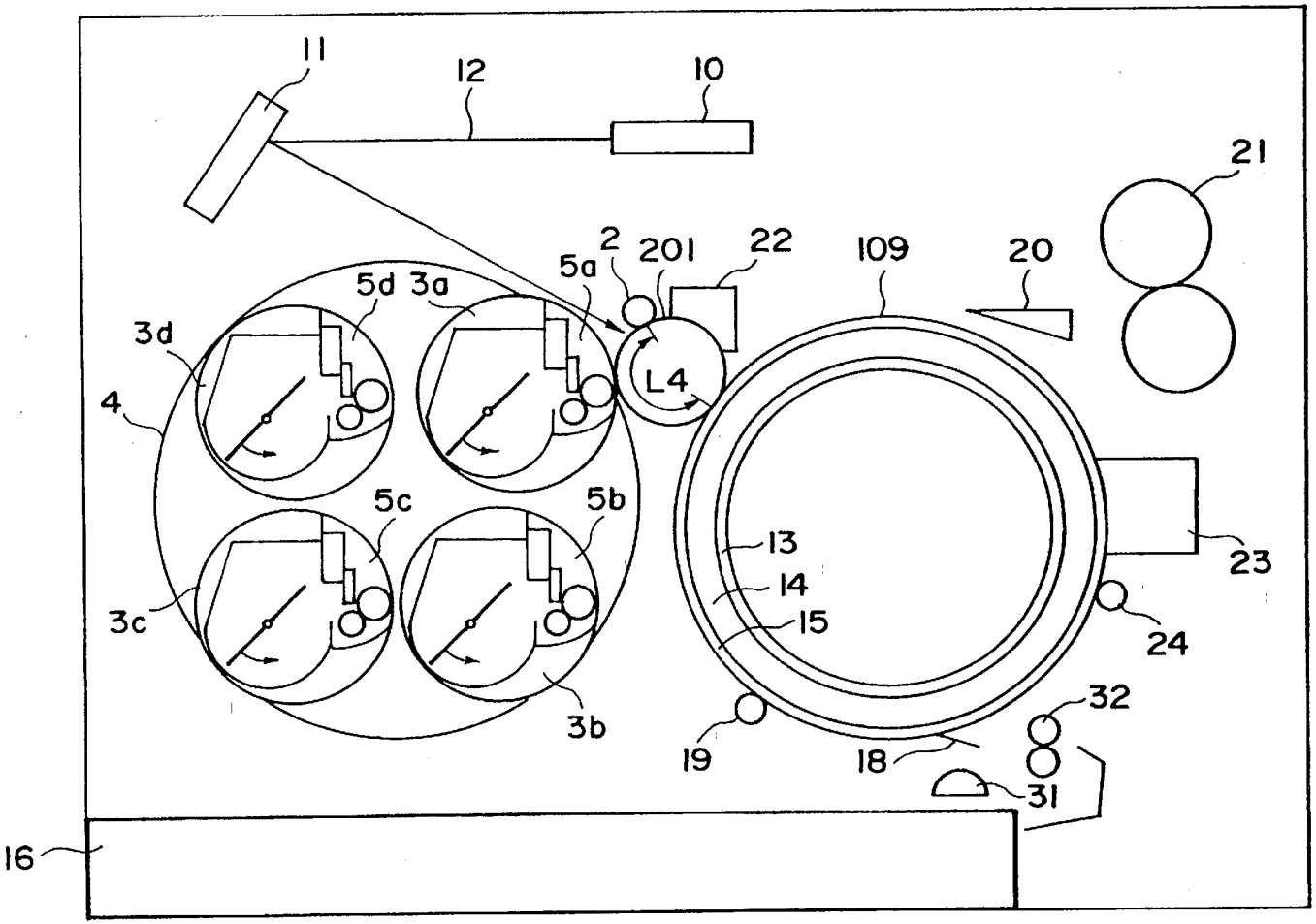
FIG. 2 is a general arrangement of a multi-color image forming apparatus according to a second embodiment of the present invention.

In FIG. 2, the peripheral length of the photosensitive drum 201 is L2, and the transfer drum 109 has a peripheral length L1. In addition, the OHP sheet (transparent resin sheet) has a length L3.

In this embodiment, the length of the feeding path from a point where the transfer material is separated from the transfer drum 109 to the fixing device 21 is shorter than the length of the transfer material, thus reducing the size of the apparatus. In addition, the circumferential length L2 of the photosensitive drum 201, the circumferential length L1 of the transfer drum and the length L3 of the OHP sheet satisfy L1–L3>L2. More particularly, the diameter of the transfer drum 109 is 160 mm (peripheral length L1 thereof is 502.7 mm), the diameter of the photosensitive drum 201 is 40 mm (the circumferential length L2 thereof is 125.7 mm). The OHP sheet size is A4 (297 mm) (longitudinal feeding), or a letter size (279 mm) (longitudinal feeding). The circumferential length of the transfer drum is preferably an integer multiple of the peripheral length or circumferential length of the photosensitive drum.

Figure 5:
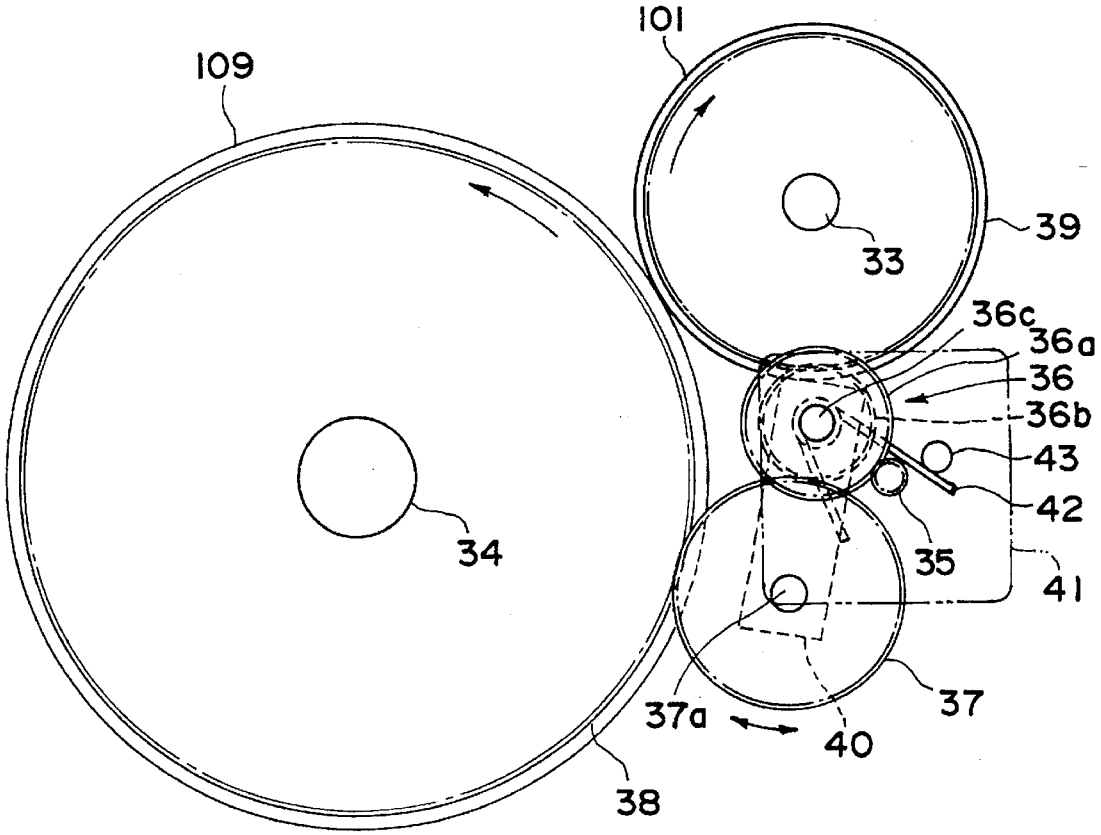
FIG. 5 is a sectional view of a driving mechanism for a multi-color image forming apparatus.

Referring to FIG. 5, the description will be made as to driving means for the transfer drum 109 and the photosensitive drum 101.

In this embodiment an output shaft of a motor 41 for driving the transfer drum 109 and the photosensitive drum 101 is provided with a gear 35, which is in meshing engagement with a large gear 36*a* of the stepped gear 36. The small one 36*b* of the two-step gear 36 is in meshing engagement with gears 37 and 39. Here, the gear 39 is mounted to a flange of the photosensitive drum 101 to rotate integrally with the photosensitive drum 101. The gear 37 is mounted to a flange of the transfer drum 109 and is in meshing engagement with a gear 38 integrally rotatable with the transfer drum 109.

The gear 37 is rotatably mounted to a shaft 37*a* secured to an end of a rotatable disk 40. THe rotatable disk 40 is rotatably mounted around a rotational shaft 36*c* of the step gear 39, at the other end. The rotatable disk 40 is urged in the clockwise direction in FIG. 9 by a torsion coil spring 42. Therefore, the gear 30 is normally urged toward the gear 38. The coil spring 42 is mounted to the shaft 36*c*, and one arm thereof is hooked on a pin 43, and the other arm is hooked on the rotatable disk 40.

With this structure, the rotational force of the motor 41 is transmitted to the gears 35 and 36 (36*a* and 36*b*) to rotate the photosensitive drum 101, and simultaneously, the rotational force of the motor 41 is transmitted to the gears 35 and 36 (36*a* and 36*b*), 37 and 38 to rotate the transfer drum 109.

The apparatus of this embodiment is operable in a plain paper mode for plain paper as the transfer material, a special sheet mode for an OHP sheet as the transfer material. The modes are selectable by a switch on an operation panel.

The transfer material fed out by the pick-up roller 31 is stopped by a registration roller 32 for the purpose of timed relation with the gripper 18 of the transfer drum. The transfer material is refed in synchronism with the gripper 18 and is gripped thereby. Then, it is electrostatically attracted on the transfer drum to permit transfer operation. Then, three color images are transferred, and then the fourth color transfer is executed. In the plain paper mode, the leading edge of the transfer material is separated by separation claws 20 in the fourth color transfer operation. Thus, the leading edge of the transfer material is separated and fed to the fixing device, during the fourth color transfer operation. However, in the special sheet mode, the leading edge of the transfer material is not separated during the fourth color transfer operation, and the transfer drum 109 is rotated further through one full-turn while attracting thereon the transfer material.

At this time, at the point of completion of the transfer action of the fourth color image trailing end onto the transfer material, the DC voltage is changed from −700 V to approx. 0 V, while the alternating voltage component remains unchanged, for the charging roller 2, by which the photosensitive drum 101 is discharged to substantially 0 V. When the photosensitive drum discharging is effected for at least one full-turn and before the leading edge of the transfer material re-enter the transfer region, the charger and discharger for the drum (alternating voltage applied to the charging roller) are rendered off, thereafter, the speeds of the photosensitive drum 101 and the transfer drum 109 are reduced to the speed with which the image can be sufficiently fixed on the OHP sheet. More particularly, when the normal process speed is 100 mm/sec, the fixing speed for the OHP sheet is 40 mm/sec.

In this case, the circumferential length L1 of the transfer drum 109, and the length of the transfer material L3 is 297 mm, and therefore, 205.7 mm region remains without the transfer material wrapped. On the other hand, the circumferential length L2 of the photosensitive drum 101 is 125.7 mm, and therefore, L1–L3>L2 is satisfied, by which the photosensitive drum can be discharged through more than one-full-turn before the leading edge of the transfer material enters the transfer position after the completion of the fourth color image transfer operation. For this reason, the speed of the photosensitive drum can be reduced, while the charging and discharging of the photosensitive drum 101 is switched.

By doing so, L1/L2>3 is satisfied. In other words, the photosensitive drum is sufficiently downsized, without inconveniences such as charge memory or transfer memory, while the apparatus is downsized. Thus, OHP sheet print can be provided with high transparency.

Embodiment 2

Referring to FIG. 2, the description will be made as to a multi-color image forming apparatus according to a second embodiment of the present invention, wherein the photosensitive drum 201 has a circumferential length L6, and the transfer drum 109 has a circumferential length L5, and the OHP transfer sheet has a length L3. The distance from the position of the discharger 2 for the photosensitive drum 201 to the transfer position in the direction of the movement of the circumference of the drum 201 is L4.

In this embodiment, the length of the feeding path from a point where the transfer material is separated from the transfer drum 109 to the fixing device 21 is shorter than the length of the transfer material, thus reducing the size of the apparatus. In addition, the circumferential length L6 of the photosensitive drum 201, the circumferential length L5 of the transfer drum, the length L3 of the OHP sheet and the distance L5 between the charging device 2 and the transfer position satisfy L5–L3+L4>L6. More particularly, the diameter of the transfer drum 109 is 120 mm (peripheral length L1 thereof is 376.8 mm), the diameter of the photosensitive drum 201 is 30 mm (the circumferential length L2 thereof is 94.2 mm). The distance between the transfer position and the photosensitive drum discharger position, which is a charging roller 2 having charging and discharging functions. The OHP sheet size is A4 (297 mm) (longitudinal feeding), or a letter size (279 mm) (longitudinal feeding).

The transfer material fed out by the pick-up roller 31 is stopped by a registration roller 32 for the purpose of timed relation with the gripper 18 of the transfer drum. The transfer material is refed in synchronism with the gripper 18 and is gripped thereby. Then, it is electrostatically attracted on the transfer drum to permit transfer operation. Then, three color images are transferred, and then the fourth color transfer is executed. In the plain paper mode, the leading edge of the transfer material is separated by separation claws 20 in the fourth color transfer operation. Thus, the leading edge of the transfer material is separated and fed to the fixing device, during the fourth color transfer operation. However, in the special sheet mode, the leading edge of the transfer material is not separated during the fourth color transfer operation, and the transfer drum 109 is rotated further through one full-turn while attracting thereon the transfer material.

When such a position on the photosensitive drum 201 as is going to correspond to a trailing edge of the force color image passes by the charging roller 2, the DC component of the voltage applied to the charging roller 2 is changed from −700 V to approx. 0 V while maintaining the alternating component, by which the photosensitive drum 201 is discharged to approx. 0 V. The charger and discharger for the photosensitive drum is rendered off (the alternating component is rendered off) when the photosensitive drum 201 is discharged by one full-turn or more and before the leading edge of the transfer material enters the transfer zone after the transfer. Thereafter, the speeds of the photosensitive drum 201 and the transfer drum 109 are reduced down to the speed for sufficient image fixing on the OHP sheet.

Figure 6:
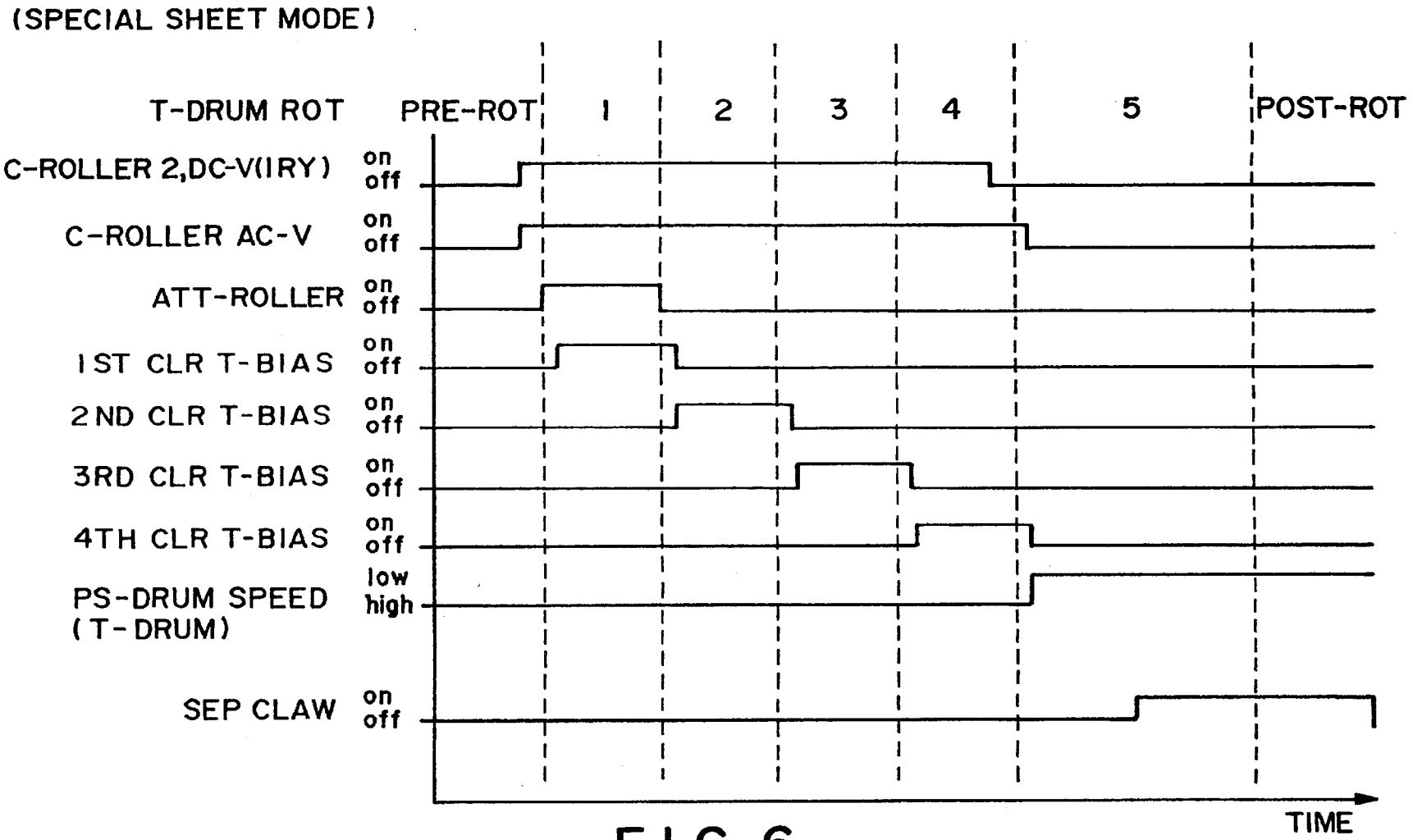
FIG. 6 is a timing chart for an image forming apparatus according to the second embodiment.

FIG. 6 is a timing chart in a special mode in this embodiment. After the position which is going to correspond to the trailing edge of the fourth color image passes through the primary charging position, the DC voltage for the charging roller is stopped. The time period from the stoppage of the DC voltage of the charging roller to the stoppage of the AC voltage for the charging roller is longer than the time required for one full-turn of the photosensitive drum 201. After the AC voltage for the charging roller is rendered off, the speeds of the photosensitive drum 201 and the transfer drum 109 are switched from the normal process speed to the speed capable of fixing the image on the OHP sheet. The speed reduction is carried out after the completion of the transfer of the fourth color image onto the OHP sheet carried on the transfer drum but before the OHP sheet reaches the fixing position. As described hereinbefore, the completion of the discharging operation of the photosensitive drum 201 by the charging roller 2 is prior to the speed reduction, and at least prior to the arrival of the OHP sheet at the fixing position.

In this case, the circumferential length L5 of the transfer drum 109 is 376.8 mm, and the length L3 of the transfer material is 297 mm, and therefore, the region (L5–L3) in which the transfer material is not wrapped around the photosensitive drum is 79.8 mm. On the other hand, the circumferential length L6 of the photosensitive drum 201 is 94.2 mm, and therefore L5–L3<L6 is satisfied. Before the leading edge of the transfer material re-enter the transfer position after the fourth color transfer is completed, the photosensitive drum 201 is not discharged more than full-turn. However, if the discharging of the photosensitive drum is started at the timing when the portion which is going to correspond to the trailing edge of the fourth color image passes by the charging roller 2, the photosensitive drum 201 is discharged more than one-full-turn before the leading edge of the transfer material enters the transfer position. Further, the charging-discharging relation is rendered off, and the speed can be reduced. Since the length from the charging roller 2 to the transfer position L4 is 55 mm, L5–L3+L4>L6, and L5/L6≧3. By starting the drum discharging at the point of time when a position corresponding to the trailing edge of the fourth color image passes by the charging position, an OHP sheet print exhibiting good transparency can be produced without inconveniences such as charge memory, transfer memory or the like, while the diameter of the transfer drum is further reduced.

In addition by the sufficient reduction of the diameter of the photosensitive drum, that is, by employing the relationship of L5/L6≧3, the photosensitive drum and the cleaner or the like are unified for easy maintenance by the users, thus improving the operativity of the apparatus.

Embodiment 3

Figure 3:
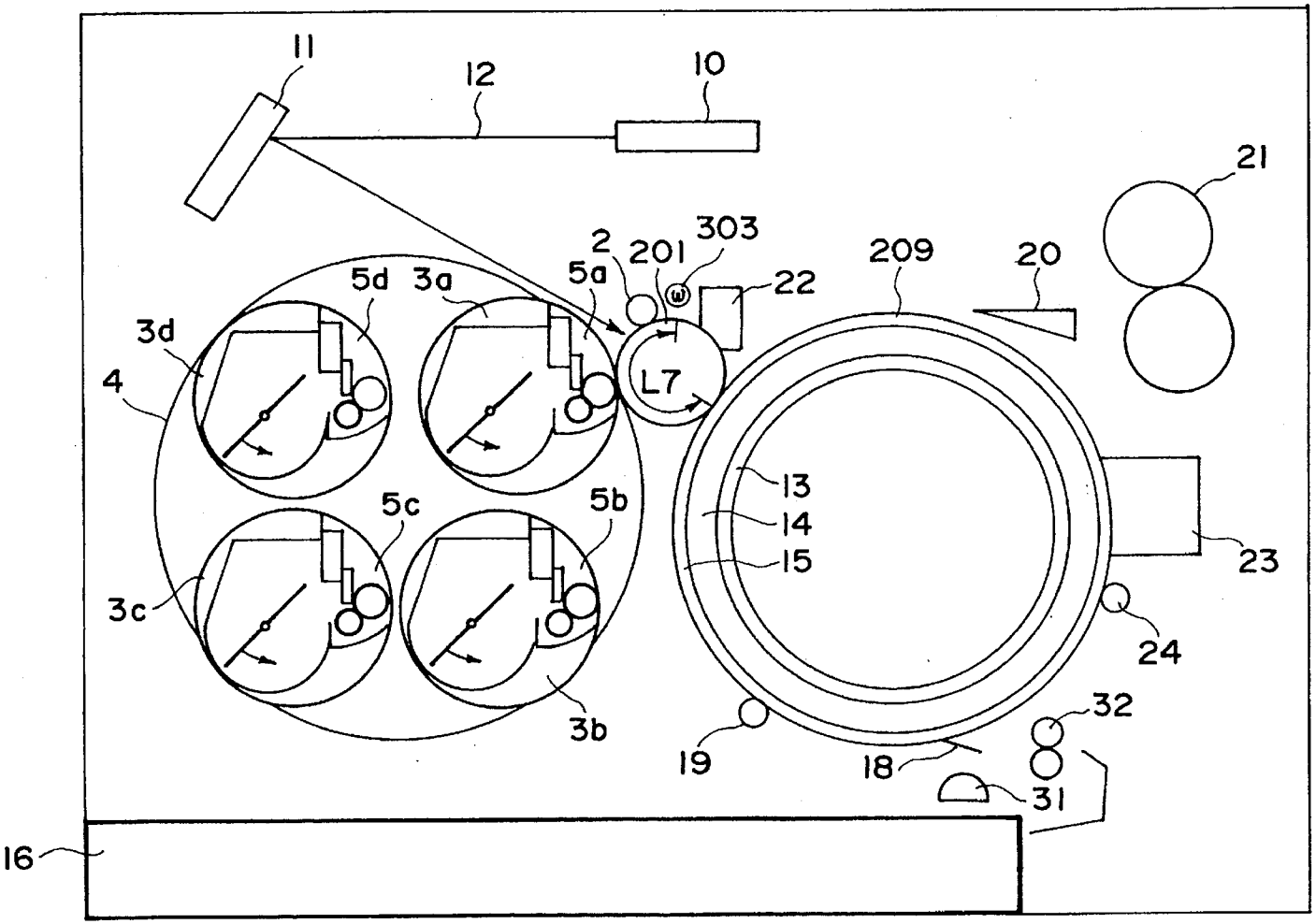
FIG. 3 is a general arrangement of a multi-color image forming apparatus according to a third, fourth and fifth embodiments of the present invention.

Referring to FIG. 3, the third embodiment of the multicolor image forming apparatus according to the present invention will be described. In the first and second embodiment, the charging roller 2 is supplied with an alternating voltage to provide charging and discharging functions of the charging roller 2. In this embodiment, the charging roller 2 is supplied with a DC voltage only and therefore functions only as a charger. There is provided a pre-exposure device prior to the charging device (pre-exposure device) 303, by which the charging and discharging functions are separated. The charging roller 2 is supplied with a DC voltage of −1250 V, so that the photosensitive drum 201 is uniformly charged to −700 V. By doing so, the vibration and the resultant noise of the photosensitive drum which is produced by application of an alternating electric field between the charging roller 2 and the drum, can be avoided, thus providing the user with better ambience. When the photosensitive drum 201 is discharged, the voltage applied to the exposure device 303 is not changed, and the quantity of the light of the exposure device is substantially constant.

Similarly to the second embodiment, the photosensitive drum 201 has a circumferential length L6, and the transfer drum 209 has a circumferential length L5. The OHP sheet has a length L3. The distance between the pre-exposure device 303 and the transfer position as measured on the photosensitive drum 201 is L7.

In this embodiment, the length of the feeding path from a point where the transfer material is separated from the transfer drum 209 to the fixing device 21 is shorter than the length of the transfer material, thus reducing the size of the apparatus. In addition, the circumferential length L6 of the photosensitive drum 201, the circumferential length L5 of the transfer drum and the length L3 of the OHP sheet and the distance L7 between the pre-exposure position 303 and the transfer position, satisfy L5–L3+L7>L6. More particularly, the diameter of the transfer drum 209 is 120 mm (peripheral length L1 thereof is 376.8 mm), the diameter of the photosensitive drum 201 is 30 mm (the circumferential length L2 thereof is 94.2 mm). The distance between the discharger for the photosensitive drum 201 which is the pre-exposure 303 in this embodiment and the transfer position is 60 mm. The OHP sheet size is A4 (297 mm) (longitudinal feeding), or a letter size (279 mm) (longitudinal feeding).

The transfer material fed out by the pick-up roller 31 is stopped by a registration roller 32 for the purpose of timed relation with the gripper 18 of the transfer drum. The transfer material is refed in synchronism with the gripper 18 and is gripped thereby. Then, it is electrostatically attracted on the transfer drum to permit transfer operation. Then, three color images are transferred, and then the fourth color transfer is executed. In the plain paper mode, the leading edge of the transfer material is separated by separation claws 20 in the fourth color transfer operation. Thus, the leading edge of the transfer material is separated and fed to the fixing device, during the fourth color transfer operation. However, in the special sheet mode, the leading edge of the transfer material is not separated during the fourth color transfer operation, and the transfer drum 209 is rotated further through one full-turn while attracting thereon the transfer material.

When such a position on the photosensitive drum as is going to correspond to the trailing edge of the fourth color image passes by the charging roller 2, the DC voltage applied to the charging roller 2 is stopped, and the photosensitive drum 201 is electrically discharged by the pre-exposure device alone. In this case, the discharging as already started at the pre-exposure position upstream of the charging roller 2. The charger and discharger for the photosensitive drum are rendered off when the photosensitive drum 201 is electrically discharged more than one full-turn and before the leading edge of the transfer material re-enter the transfer region. Thereafter, the speed of the photosensitive drum 201 and the transfer drum 209 are reduced down to the speed for sufficient fixing.

The circumferential length L5 of the transfer drum 209 is 376.8 mm, and the length of the transfer material L3 is 297 mm, and therefore, the region on the transfer drum without the transfer material is 79.3 mm. On the other hand, the circumferential length L6 of the photosensitive drum 201 is 94.2 mm, and therefore, L5–L3<L6 is satisfied. Before the re-entering of the leading edge of the transfer material after the completion of the fourth color transfer, it is not possible to discharge the photosensitive drum 201 more than one full-turn. However, if the DC voltage applied to the charging roller 2 is rendered off at the point of time when the position which is going to correspond to the trailing edge of the fourth color image passes by the charging roller 2, and by discharging the photosensitive drum 201 by the pre-exposure device 303 alone, the photosensitive drum 201 is discharged more than one full-turn before the leading edge of the transfer material enters the transfer position, the speeds can be further reduced. Since the length L7 from the pre-exposure position 303 is 60 mm, L5–L3+L7>L6, and L5/L6≧3. THerefore, an OHP sheet print having good transparency can be produced without inconveniences of charging memory, transfer memory or the like, while the diameter of the transfer drum is reduced, in this manner.

In the foregoing embodiment, the use has been made with a charging roller as the charging means for the photosensitive drum, but corona charger, brush charger or another charging means is usable in place thereof.

Embodiment 4

Referring to FIG. 3, a multi-color image forming apparatus according to a fourth embodiment of the present invention will be described. In this embodiment, the diameter of the transfer drum 209 is 160 mm, and that of the photosensitive drum 201 is 40 mm. As for the OHP transfer sheet, the size thereof is A4 and is longitudinally fed (297 mm in the longitudinal direction), or a letter size and is longitudinally fed (279 mm).

The transfer material fed out by the pick-up roller 31 is stopped by a registration roller 32 for the purpose of timed relation with the gripper 18 of the transfer drum. The transfer material is refed in synchronism with the gripper 18 and is gripped thereby. Then, it is electrostatically attracted on the transfer drum to permit transfer operation. Then, three color images are transferred, and then the fourth color transfer is executed. In the plain paper mode, the leading edge of the transfer material is separated by separation claws 20 in the fourth color transfer operation. Thus, the leading edge of the transfer material is separated and fed to the fixing device, during the fourth color transfer operation. However, in the special sheet mode, the leading edge of the transfer material is not separated during the fourth color transfer operation, and the transfer drum 209 is rotated further through one full-turn while attracting thereon the transfer material.

Subsequently, before the leading edge of the transfer material re-enter the transfer region, the chargers and dischargers for the photosensitive drum 201 are rendered off, and thereafter, the speeds of the photosensitive drum 201 and the transfer drum 209 are reduced to such an extent that the OHP sheet is sufficiently fixed. More particularly, the normal process speed 100 mm/sec is reduced to 40 mm/sec. At this time, the DC voltage applied to the charging roller 2 and the pre-exposure device 303 are stopped.

The OHP transfer material is separated at the separation point, and enters the fixing apparatus having been controlled to meet 40 mm/sec.

After the trailing edge of the transfer material passes through the fixing device, the process speed returns to 100 mm/sec, and the pre-exposure device 303 is actuated to discharge the photosensitive drum 201 by one full-turn to substantially 0 V. Also, the transfer drum 209 is discharged by one full-turn to substantially 0 V by the discharging roller 24. Thereafter, the apparatus is stopped.

Figure 7:
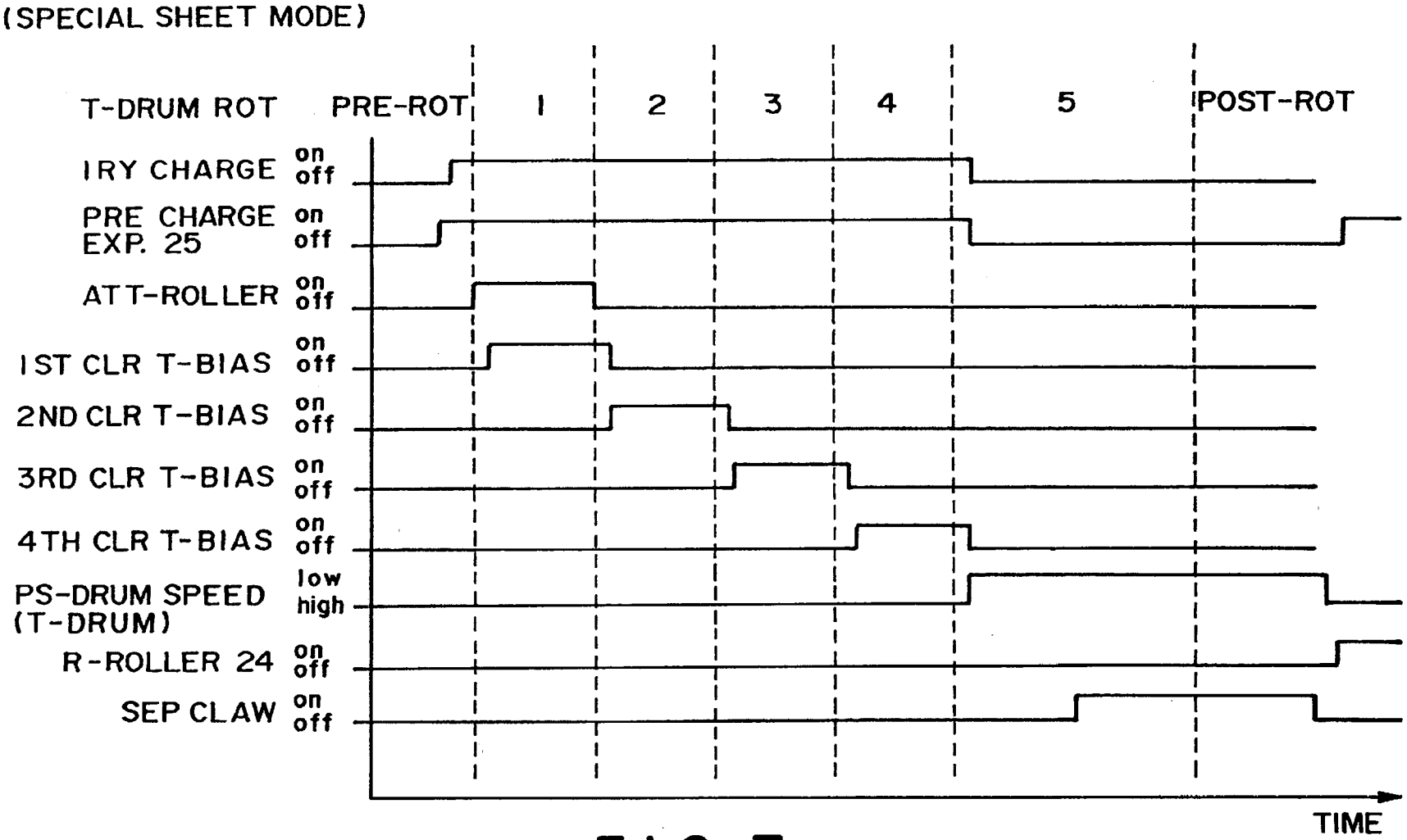
FIG. 7 is a timing chart for an image forming apparatus according to the fourth embodiment of the present invention.

FIG. 7 is a timing chart of the operation in this embodiment.

By doing so, when the process speed is low, the charging, discharging and exposure operations are not carried out, but all the operations are carried out when the process speed is normal. In addition, the discharging is carried out immediately before stop of the apparatus, and therefore, the good images can be produced without charge memory, transfer memory or improper discharge of the transfer drum, while the size of the apparatus is reduced.

Embodiment 5

Referring back to FIG. 3, a multi-color image forming apparatus according to the fifth embodiment of the present invention will be described.

In this embodiment, the driving source for the fixing device 21 is separate from that for the photosensitive drum 101 and the transfer drum 209.

The transfer material fed out by the pick-up roller 31 is stopped by a registration roller 32 for the purpose of timed relation with the gripper 18 of the transfer drum 209. The transfer material is refed in synchronism with the gripper 18 and is gripped thereby. Then, it is electrostatically attracted on the transfer drum 209 to permit transfer operation. Then, three color images are transferred, and then the fourth color transfer is executed. In the plain paper mode, the leading edge of the transfer material is separated by separation claws 20 in the fourth color transfer operation. Thus, the leading edge of the transfer material is separated and fed to the fixing device, during the fourth color transfer operation. However, in the special sheet mode, the leading edge of the transfer material is not separated during the fourth color transfer operation, and the transfer drum 209 is rotated further through one full-turn while attracting thereon the transfer material.

Before the leading edge of the transfer material re-enter the transfer region, the charging and discharging devices for the photosensitive drum are stopped, and thereafter, the speeds of the photosensitive drum 201 and the transfer drum 209 are reduced to the level permitting sufficient fixing on the OHP sheet. More particularly, the normal process speed 100 mm/sec is reduced to 400 mm/sec. At this time, the DC voltage applied to the charging roller 2 and the pre-exposure device 25 are stopped.

The transfer material (OHP sheet) is separated at the next separation point, and is introduced into the fixing device 21 having been controlled to meet 40 mm/sec.

Immediately after separation of the trailing edge of the transfer material from the transfer drum, the process speeds of the photosensitive drum 201 and the transfer drum 209 are returned to the original 100 mm/sec. At this time, the transfer material is still in the fixing device, but the photosensitive drum 201 and the transfer drum 209 are driven by a device separate from the fixing device 21, and the speed of the fixing device 21 remains unchanged until the transfer material is passed through, that is, 40 mm/sec is maintained.

Immediately after the speeds of the photosensitive drum 201 and the transfer drum 209 are returned to 100 mm/sec, the photosensitive drum 201 is discharged by one full-turn, and the transfer drum 209 is discharged by discharging roller 24 by one full-turn, and thereafter, the apparatus is stopped.

By doing so, the discharging for the photosensitive drum 201 and the transfer drum 209 can be started earlier, thus permitting reduction of the number of rotations until the stoppage. Therefore, the service lives of the photosensitive drum and the transfer drum can be expanded while the advantageous effects of Embodiment 1 are retained.

Embodiment 6

Referring to FIG. 1, a multi-color image forming apparatus according to the sixth embodiment will be described. In the fourth and fifth embodiments, the charging roller 2 is supplied with only a DC voltage and therefore functions only as a charger. A pre-exposure device 303 is provided so that the charging and discharging functions are separated. In the sixth embodiment, the pre-exposure device 303 is omitted, and the charging roller 2 is supplied with a DC voltage of −700 V biased with an AC voltage having a frequency of 1000 Hz and a peak-to-peak voltage Vpp of 2000 V. The photosensitive drum 1 is uniformly charged to −700 V. When the photosensitive drum 101 is discharged, the applied alternating voltage is maintained, and the DC voltage is set to approx. 0 V.

With this structure, the pre-exposure device can be omitted so that the cost reduction is possible.

The transfer material fed out by the pick-up roller 31 is stopped by a registration roller 32 for the purpose of timed relation with the gripper 18 of the transfer drum. The transfer material is refed in synchronism with the gripper 18 and is gripped thereby. Then, it is electrostatically attracted on the transfer drum to permit transfer operation. Then, three color images are transferred, and then the fourth color transfer is executed. In the plain paper mode, the leading edge of the transfer material is separated by separation claws 20 in the fourth color transfer operation. Thus, the leading edge of the transfer material is separated and fed to the fixing device, during the fourth color transfer operation. However, in the special sheet mode, the leading edge of the transfer material is not separated during the fourth color transfer operation, and the transfer drum 109 is rotated further through one full-turn while attracting thereon the transfer material.

Before the leading edge of the transfer material re-enter the transfer region, the charger and dischargers for the photosensitive drum are rendered off, and thereafter, the speeds of the photosensitive drum 101 and the transfer drum 9 are reduced to such an extent that the fixing operation is sufficient on the OHP sheet. More particularly, the process speed is reduced from normal 100 mm/sec to 40 mm/sec. At this time, the DC voltage applied to the charging roller 2 and the pre-exposure device are stopped.

The OHP sheet is separated at the next separation point, and is introduced to the fixing device already set to 40 mm/sec.

After the trailing edge of the transfer material has passed through the fixing device, the process speed is returned to original 100 mm/sec, and the DC component of the bias voltage applied to the charging roller 2 is changed to approx. 0 V, by which the photosensitive drum 101 is discharged at least one full-turn, and the transfer drum 9 is also discharged by discharging roller 24 by at least one turn. Thereafter, the apparatus is stopped.

By doing so, the charging and discharging operation are prevented from being carried out when the process speed is low, and such operations are all carried out when the process speed is normal. Immediately before the stoppage of the apparatus, the discharging operation is carried out. Therefore, good images can be provided without charge memory, improper discharge of the photosensitive drum or another inconveniences, while reducing the size and cost of the apparatus.

According to 4–6 embodiments, the corona charger, brush charger or other charging means is usable in place of the charging roller.

In the foregoing embodiments, the distance between the separation position of the transfer drum 9 and the fixing position can be set smaller than the special sheet such as OHP sheet or the like, as measured in the direction of the feeding of the transfer material.

As another example of the special speed, there is a thick sheet of paper having a larger basis weight than usual sheets.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus comprising:

an image bearing member for bearing an image with a leading and trailing edge, said image bearing member being rotatable at a first speed and a second speed which is different from said first speed, wherein during image formation on said image bearing member, said first speed is selected, and after completion of image formation on said image bearing member, a speed of rotation of said image bearing member is switchable from said first speed to said second speed;

discharging means for electrically discharging said image bearing member at a discharging position, said discharging means discharging said image bearing member at least one turn of said image bearing member after such a portion as is going to be the trailing edge of the image passes through the discharging position and before the speed of said image bearing member is switched from said first speed to said second speed.

2. An apparatus according to claim 1, further comprising a rotatable recording material carrying member for carrying a recording material, wherein the image is transferred from said image bearing member onto the recording material carried on said recording material carrying member at a transfer position.

3. An apparatus according to claim 2, wherein an operation of said discharging means is completed by the time a leading edge of the recording material carried on said recording material carrying member reaches the transfer position, after completion of the image transfer.

4. An apparatus according to claim 3, wherein a circumferential length of said recording material carrying member L1, a circumferential length of said image bearing member L2, a length of the recording material L3 measured along rotational direction of said recording material carrying member, a distance L4 from the discharging position to the transfer position measured in a rotational direction of said image bearing member, satisfy:

$$L1-L3+L4>L2.$$

5. An apparatus according to claim 1, wherein said second speed is lower than said first speed.

6. An apparatus according to claim 2, wherein said second speed is lower than said first speed.

7. An apparatus according to claim 6, further comprising image fixing means for fixing the image on the recording material after the image is transferred from said image bearing member, wherein said fixing means is operable in a first mode in which said image bearing member rotates at said first speed, and in a second mode in which said image bearing member rotates in the second speed.

8. An apparatus according to claim 7, wherein a speed of said image bearing member during image fixing operation is smaller in the second mode than in the first mode.

9. An apparatus according to claim 2, wherein a circumferential length L1 of said recording material carrying member and a circumferential length L2 of said image bearing member satisfy:

$$L1/L2 \geqq 3.$$

10. An apparatus according to claim 7 or 8, wherein a distance from a separating position where the recording material is separated from said recording material carrying member to a fixing position of said fixing means, is smaller than a length of the recording material measured along rotation of said recording material carrying member.

11. An apparatus according to any one of claims 2–4 and 6–9, further comprising a common driving source for driving said image bearing member and said recording material carrying member.

12. An apparatus according to any one of claims 2–4 or 9, further comprising image fixing means for fixing an image on the recording material after image transfer, wherein a distance from a separating position where the recording material is separated from said recording material carrying member and an image fixing position of said image fixing means is smaller than a length of the recording material measured along rotation of said recording material carrying member.

13. An apparatus according to claim 10, further comprising a common driving source for driving said image bearing member and said recording material carrying member.

14. An apparatus according to claim 12, further comprising a common driving source for driving said image bearing member and said recording material carrying member.

15. An apparatus according to claim 2, wherein images of different colors are transferable onto the recording material carried on said recording material carrying member.

16. An apparatus according to claim 15, wherein said apparatus is capable of forming a full-color image on the recording material.

17. An image forming apparatus comprising:

an image bearing member for bearing an image, said image bearing member being rotatable at a first speed and a second speed which is different from said first speed, wherein during image formation on said image bearing member, said first speed is selected, and after completion of image formation on said image bearing member, said first speed and said second speed are selectable;

discharging means for electrically discharging said image bearing member at a discharging position, wherein said discharging means electrically discharges said image bearing member after a speed is switched from said second speed to said first speed after completion of image formation of said image bearing member.

18. An apparatus according to claim 17, further comprising a rotatable recording material carrying member for carrying a recording material, wherein the image is transferred from said image bearing member onto the recording material carried on said recording material carrying member at a transfer position.

19. An apparatus according to claim 17, wherein said second speed is lower than said first speed.

20. An apparatus according to claim 18, wherein said second speed is lower than said first speed.

21. An apparatus according to claim 20, further comprising image fixing means for fixing the image on the recording material after the image is transferred from said image bearing member, wherein said fixing means is operable in a first mode in which said image bearing member rotates at said first speed, and in a second mode in which said image bearing member rotates in the second speed.

22. An apparatus according to claim 21, wherein a speed of said image bearing member during image fixing operation is smaller in the second mode than in the first mode.

23. An apparatus according to claim 18, 20, 21 or 22, further comprising driving means for said image bearing member and said recording material carrying member.

24. An apparatus according to claim 21 or 22, wherein a distance from a separating position where the recording material is separated from said recording material carrying member to a fixing position of said fixing means, is smaller than a length of the recording material measured along rotation of said recording material carrying member.

25. An apparatus according to any one of claims 18–20, further comprising image fixing means for fixing an image on the recording material after image transfer, wherein a distance from a separating position where the recording material is separated from said recording material carrying member to an image fixing position of said image fixing means is smaller than a length of the recording material measured along rotation of said recording material carrying member.

26. An apparatus according to 24, further comprising driving means for said image bearing member and said recording material carrying member.

27. An apparatus according to claim 18, wherein images of different colors are transferable onto the recording material carried on said recording material carrying member.

28. An apparatus according to claim 27, wherein said apparatus is capable of forming a full-color image on the recording material.

29. An image forming apparatus comprising:

an image bearing member for carrying an image;

a recording material carrying member for carrying a recording material, wherein an image is transferred from said image bearing member onto a recording material carried on said recording material carrying member, wherein said recording material carrying member is rotatable at a first speed and a second speed which is different from said first speed, wherein during image transfer operation said first speed is selected, after completion of the image transfer operation, said first or second speed is selectable; and discharging means for discharging said recording material carrying member at a discharging position, wherein after completion of image transfer a speed of said recording material carrying member is switched from said second speed to said first speed, and after said switching, said discharging means discharges said recording material carrying member.

30. An apparatus according to claim 29, wherein said second speed is lower than said first speed.

31. An apparatus according to claim 30, further comprising image fixing means for fixing the image on the recording material after the image is transferred from said image bearing member, wherein said fixing means is operable in a first mode in which said recording material carrying member rotates at said first speed, and in a second mode in which said recording material carrying member rotates in the second speed.

32. An apparatus according to claim 31, wherein a speed of said image bearing member during image fixing operation is smaller in the second mode than in the first mode.

33. An apparatus according to any one of claim 29–32, further comprising driving means for said image bearing member and said recording material carrying member.

34. An apparatus according to claim 31 or 32, wherein a distance from a separating position where the recording material is separated from said recording material carrying member to a fixing position of said fixing means, is smaller than a length of the recording material measured along rotation of said recording material carrying member.

35. An apparatus according to claim 29 or 30, further comprising image fixing means for fixing an image on the recording material after image transfer, wherein a distance from a separating position where the recording material is separated from said recording material carrying member to an image fixing position of said image fixing means is smaller than a length of the recording material measured along rotation of said recording material carrying member.

36. An apparatus according to claim 34, further comprising driving means for said image bearing member and said recording material carrying member.

37. An apparatus according to claim 35, further comprising driving means for said image bearing member and said recording material carrying member.

38. An apparatus according to claim 29, wherein the images of different colors are transferable onto the recording material carried on said recording material carrying member.

39. An apparatus according to claim 38, wherein said apparatus is capable of forming a full-color image on the recording material.

40. An apparatus according to claim 7, 21 or 31, wherein an image fixing speed of said image fixing means is smaller in said second mode than in said first mode.

41. An apparatus according to claim 31, wherein in said second mode, the rotational speed of said recording material carrying member is switched from said first speed to said second speed.

42. An apparatus according to claim 7 or 21, wherein in said second mode, the rotational speed of said image bearing member is switched from said first speed to said second speed.

* * * * *

UNITED STATES PATENT AND TRADEMARK OFFICE

CERTIFICATE OF CORRECTION

PATENT NO. : 5,666,597
DATED : September 9, 1997
INVENTOR(S) : Hiroshi SASAME, et al.

It is certified that error appears in the above-indentified patent and that said Letters Patent is hereby corrected as shown below:

Column 1, line 43, delete "excepts" and insert therefor --except--.

Column 2, line 8, delete "4.303858" and insert therefor --4,303,858--.

Column 6, line 53, delete "functions." and insert therefor --functions 55mm.--.

Column 7, line 66, after "addition", insert a comma (",").

Column 13, line 33, delete "and" and insert therefor --or--.

Column 16, line 12, delete "the".

Signed and Sealed this

Thirty-first Day of March, 1998

*Attest:*

Bruce Lehman

BRUCE LEHMAN

*Attesting Officer*

*Commissioner of Patents and Trademarks*